US010950369B1

(12) United States Patent
Farkas et al.

(10) Patent No.: US 10,950,369 B1
(45) Date of Patent: Mar. 16, 2021

(54) INVERTED CABLE DESIGN FOR HIGH-SPEED, LOW LOSS SIGNAL TRANSMISSION

(71) Applicant: DELL PRODUCTS L.P., Round Rock, TX (US)

(72) Inventors: Sandor Farkas, Round Rock, TX (US); Bhyrav Mutnury, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/933,639

(22) Filed: Jul. 20, 2020

(51) Int. Cl.
*H01B 11/18* (2006.01)

(52) U.S. Cl.
CPC ..... *H01B 11/1869* (2013.01); *H01B 11/1804* (2013.01); *H01B 11/1813* (2013.01); *H01B 11/1834* (2013.01)

(58) Field of Classification Search
CPC ..... H01B 11/18; H01B 11/20; H01B 11/1869; H01B 11/1804; H01B 11/1813; H01B 11/1834
USPC ..... 174/36, 74 R, 102 R, 107, 108, 85 C, 174/75 C
See application file for complete search history.

(56) References Cited

U.S. PATENT DOCUMENTS 3,504,306 A * 3/1970 Kam ..... H01F 19/04 333/26
3,743,748 A * 7/1973 Reeder ..... H01R 9/0515 174/75 C
4,060,887 A * 12/1977 De Groef ..... H01R 9/0515 29/828
4,642,417 A 2/1987 Ruthrof et al.
5,539,323 A * 7/1996 Davis, Jr. ..... G01V 9/00 324/690
6,055,722 A * 5/2000 Tighe ..... H01R 12/62 29/839
6,583,360 B1 6/2003 Yudashkin
7,314,997 B1 * 1/2008 Mui ..... H01B 11/04 174/28
7,815,466 B2 * 10/2010 Yaghmai ..... G01R 31/2889 439/581
7,841,898 B1 * 11/2010 Titus ..... H01R 24/54 439/580

(Continued)

OTHER PUBLICATIONS

TE Connectivity, "Cabled Backplane Systems, The High Speed Alternative to Print Circuit Boards (PCBs)" Data and Devices, 2017, 4 pgs.

(Continued)

*Primary Examiner* — William H. Mayo, III
(74) *Attorney, Agent, or Firm* — Egan, Enders & Huston LLP.

(57) ABSTRACT

An improved electrical cable design for high-speed, low loss signal transmission. The improved cable design may be a three-conductor cable having a center conductor, a middle conductor and an outer conductor, where each conductor is separated by a dielectric layer. The electrical cable provides an inverted cable design, in which signal transmission occurs within the middle conductor, the center conductor is used as a return or drain line to ground and the outer conductor is used as a shield. The middle conductor of the electrical cable provides a larger surface area for signal conductance than the center conductor, thereby transmitting signals with significantly less loss (e.g., at least 50% less loss).

20 Claims, 6 Drawing Sheets

(56) References Cited

U.S. PATENT DOCUMENTS

| | | | | |
|---|---|---|---|---|
| 8,859,901 | B2 | 10/2014 | Gundel | |
| 8,932,078 | B1 * | 1/2015 | Martin | H01R 24/50 439/574 |
| 10,354,778 | B2 | 7/2019 | Gundel | |
| 2003/0064625 | A1 * | 4/2003 | Ozai | H01R 13/65914 439/579 |
| 2005/0104610 | A1 * | 5/2005 | Lesher | G01R 1/18 324/750.26 |
| 2005/0270041 | A1 * | 12/2005 | Lieder | G01B 7/023 324/663 |
| 2009/0151993 | A1 * | 6/2009 | Yaghmai | G01R 31/2889 174/261 |

OTHER PUBLICATIONS

Wikipedia, "Twinaxial cabling", Captured from Internet on Jul. 15, 2020, 5 pgs.
Wikipedia, "Coaxial Cable", Captured from Internet on Jul. 18, 2020, 14 pgs.

* cited by examiner

INVERTED CABLE DESIGN FOR HIGH-SPEED, LOW LOSS SIGNAL TRANSMISSION

FIELD

This invention relates generally to electrical cables, and more particularly, to electrical cables for high-speed, low loss signal transmission.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Electrical cables (or simply "cables") have become an integral part of many information handling systems such as, for example, desktop computers, laptop computers and servers. Cables may be used externally to connect multiple information handling systems together, or internally to connect printed circuit board (PCBs) within an information handling system together. When one or more servers are installed within a rack, for example, communication between racks can be easily accomplished through externally coupled cables. Internal cables are also commonly used within rack servers for connecting Serial Attached Small Computer System Interface (Serial Attached SCSI, or SAS), Serial Advanced Technology Attachment (SATA) and non-volatile memory (NVME) backplanes.

Cables are commonly used in high-speed signal transmission applications, since they provide a lower loss mode for signal propagation compared to printed circuit board (PCB). However, with signal speeds steadily increasing, lowering the loss through cables is becoming a major design challenge for future high-speed signal transmission applications. Even though cables provide a lower loss medium than PCB, the loss through the cables may not be adequate to meet the channel budget (e.g., 15 dB) specified in some high-speed data bus standards, such as the Peripheral Component Interconnect Express (PCIe) standard, at certain cable lengths (e.g., cable lengths greater than 700 mm). While ultra-low loss materials are currently being considered, there is an ever present need to provide a lower loss cable design.

A coaxial cable (or simply "coax") is one type of electrical cable commonly used for high-speed signal transmission. As known in the art, a coaxial cable typically includes a center conductor, an insulating dielectric layer surrounding the center conductor, and an outer conductor surrounding the insulating dielectric layer, all of which is surrounded by a protective outer jacket. In a coaxial cable, the center conductor is used for single-ended signal transmission, while the outer conductor (or shield) is connected to ground.

A dual-axial cable (or twin-axial cable) is another type of electrical cable commonly used for high-speed signal transmission. As the name implies, a dual-axial cable includes two axes or center conductors, which are arranged side-by-side, or parallel to one another, for transmitting differential signals. The dual-axial cable also includes an insulating dielectric layer surrounding each of the center conductors, one or more drain wires for connecting to ground, an outer conductor (or shield) and a protective outer jacket.

FIGS. 1 and 2 provide cross-sectional views of dual-axial cables commonly used for high-speed signal transmission. As shown in FIGS. 1 and 2, dual-axial cables 10, 20 my each include a pair of center conductors 12, an insulating dielectric layer 14 surrounding each of the center conductors 12, an outer conductor (or shield) 16 surrounding the insulated conductors, and a protective outer jacket 18 surrounding the outer conductor 16. In the dual-axial cable shown in FIG. 1, a single drain wire 19 is provided near the center of the cable 10 for connecting the cable to ground. In the dual-axial cable 20 shown in FIG. 2, two drain wires 22, 24 are provided and arranged on either side of the cable 20.

In the dual-axial cables 10, 20 shown in FIGS. 1 and 2, the center conductors 12 are used for signal transmission, while the drain wire(s) are used as a return or drain line to ground. When an alternating current (AC) signal is applied to the center conductors 12, the electric current is distributed within the conductors, such that the current density is largest near the surface (or "skin") of the conductors and decreases with increasing depth (or "skin depth") within the conductors. This effect, known as the "skin effect," causes the effective resistance of the center conductors 12 to increase at higher frequencies where the skin depth is smaller, thus reducing the effective cross-section of the conductors and increasing the loss through the conductors. In many cases, the center conductors 12 used within the dual-axial cables 10, 20 may be relatively small in diameter (e.g., 20 AWG to 26 AWG). When using such small center conductors 12, losses due to the skin effect and the dielectric material make it difficult to transmit high-speed, low loss signals.

SUMMARY OF THE INVENTION

The following description of various embodiments of systems, cables and related methods is not to be construed in any way as limiting the subject matter of the appended claims.

The present disclosure generally relates to electrical cables, and more specifically, to an improved cable design for high-speed, low loss signal transmission. In some embodiments, the improved cable design may be a three-conductor cable having a center conductor, a middle conductor and an outer conductor, where each conductor is separated by a dielectric layer. For example, a first dielectric layer surrounding the center conductor may separate the center conductor from the middle conductor, and a second dielectric layer surrounding the middle conductor may separate the middle conductor from the outer conductor.

Unlike conventional cable designs, which transmit signals along the center conductor, the present disclosure provides an inverted cable design, in which signal transmission occurs within the middle conductor, the center conductor is used as a return or drain line to ground and the outer conductor is used as a shield. Because the middle conductor provides a larger surface area for signal conductance than the center conductor, the inverted cable design described herein transmits signals with significantly less loss than conventional cable designs, especially at higher signal transmission speeds and/or throughputs.

According to one embodiment, a method is provided herein for transmitting a high-speed data signal. The method may generally begin by providing an inverted cable, wherein the inverted cable comprises at least a center conductor, a middle conductor and an outer conductor. The middle conductor may be concentrically arranged around the center conductor and separated from the center conductor by a first dielectric layer. The outer conductor may be concentrically arranged around the middle conductor and separated from the middle conductor by a second dielectric layer. The method may also include coupling the center conductor and the outer conductor to a ground terminal, and coupling the middle conductor to a data terminal. The method may further include transmitting the high-speed data signal along the middle conductor, which has a larger surface area for signal conduction than the center conductor.

In some embodiments, the method may further include coupling the inverted cable between a first printed circuit board (PCB) and a second PCB included within an information handling system (IHS), such that the center conductor and the outer conductor are coupled to ground terminals on the first PCB and the second PCB, and the middle connector is coupled to data terminals on the first PCB and the second PCB.

In other embodiments, the method may further include coupling the inverted cable between a first connector provided on a chassis of a first information handling system (IHS) and a second connector provided on a chassis of a second IHS, such that the center conductor and the outer conductor are connected to ground terminals included within the first connector and the second connector, and the middle connector is connected to data terminals included within the first connector and the second connector.

Unlike conventional methods, which transmit signals along the center conductor, the method disclosed herein transmits the high-speed data signal along the middle conductor. In some embodiments, the surface area of the middle conductor may be approximately 2 to 5 times larger than the surface area of the center conductor. Because the middle conductor provides a larger surface area for signal conductance than the center conductor, the method disclosed herein transmits the high-speed data signal with significantly less loss than conventional methods, especially at higher signal transmission speeds. In one example, the method may reduce loss through the inverted cable by at least 50% by transmitting the high-speed data signal along the middle conductor, instead of the center conductor. In some embodiments, the method may transmit the high-speed data signal at a throughput greater than 15 Gigabits per second (Gbps), more specifically, greater than 40 Gbps, and more specifically, greater than 60 Gbps.

According to another embodiment, a system is provided herein, wherein the system comprises an inverted cable operable for transmitting a high-speed data signal between multiple information handling systems (IHSs), or between multiple printed circuit board (PCBs) included within an IHS. The inverted cable may comprise at least a center conductor, a middle conductor and an outer conductor. The middle conductor may be concentrically arranged around the center conductor and separated from the center conductor by a first dielectric layer. The outer conductor may be concentrically arranged around the middle conductor and separated from the middle conductor by a second dielectric layer. The inverted cable may be coupled for transmitting the high-speed data signal along the middle conductor, which has a larger surface area for signal conduction than the center conductor.

In some embodiments, the system may include a first IHS and a second IHS. In such embodiments, the inverted cable may be coupled between a first connector provided on a chassis of the first IHS and a second connector provided on a chassis of a second IHS, such that the center conductor and the outer conductor are connected to ground terminals included within the first connector and the second connector, and the middle connector is connected to data terminals included within the first connector and the second connector.

In some embodiments, the system may include a first printed circuit board (PCB) and a second PCB included within an IHS. In such embodiments, the inverted cable may be coupled between the first PCB and the second PCB, such that the center conductor and the outer conductor are coupled to ground terminals on the first PCB and the second PCB, and the middle connector is coupled to data terminals on the first PCB and the second PCB.

In some embodiments, the inverted cable may be operable for transmitting the high-speed data signal in accordance with a Peripheral Component Interconnect Express (PCIe) bus standard, a Serial Attached Small Computer System Interface (SAS) protocol, a Serial Advanced Technology Attachment (SATA) bus interface, or another communication standard, protocol or interface. In some embodiments, the inverted cable may be a dual-axial cable, as described below.

According to another embodiment, a dual-axial cable terminated at each end with a pair of mating connectors is provided herein. The dual-axial cable may generally include a pair of inner cables arranged parallel to one another, one or more second dielectric layers surrounding the pair of inner cables, an outer conductor surrounding the one or more second dielectric layers, and a protective outer jacket surrounding the outer conductor. Each of the inner cables may include a center conductor, a first dielectric layer surrounding the center conductor, and a middle conductor surrounding the first dielectric layer. Unlike conventional dual-axial cables, the center conductors and the outer conductor of the dual-axial cable described herein are coupled to ground terminals on the pair of mating connectors. The middle conductors of the dual-axial cable are coupled to data terminals on the pair of mating connectors.

In some embodiments, the dual-axial cable described herein may include a pair of second dielectric layers arranged, such that each of the second dielectric layers surrounds one of the middle conductors included within the pair of inner cables.

In some embodiments, the dual-axial cable described herein may include only one second dielectric layer wrapped around the pair of inner cables. In such embodiments, the dual-axial cable may further include a dielectric spacer inserted between the pair of inner cables.

The dual-axial cable described herein may be operable for transmitting a differential data signal along the middle conductors of the dual-axial cable. In some embodiments, the dual-axial cable may be operable for transmitting a differential data signal in accordance with a Peripheral Component Interconnect Express (PCIe) bus standard, a Serial Attached Small Computer System Interface (SAS)

protocol, a Serial Advanced Technology Attachment (SATA) bus interface, or another communication standard, protocol or interface.

BRIEF DESCRIPTION OF THE DRAWINGS

Other advantages of the present disclosure will become apparent upon reading the following detailed description and upon reference to the accompanying drawings in which.

Figure 1:
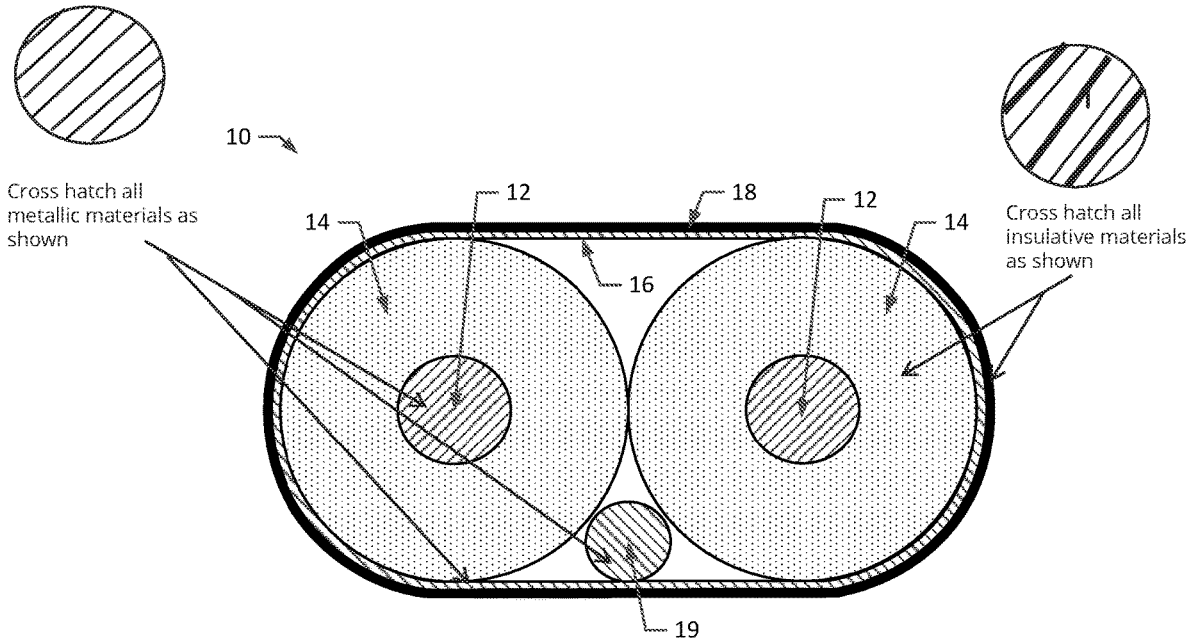
FIG. 1 (Prior Art)
FIG. 1 is a cross-sectional view through a conventional dual-axial cable.
Figure 2:
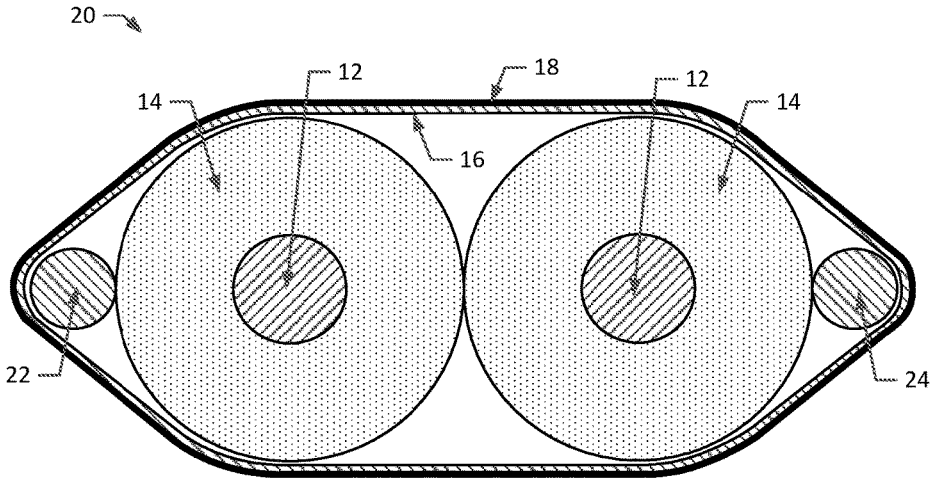
FIG. 2 (Prior Art)
FIG. 2 is a cross-sectional view through another conventional dual-axial cable.

While the present disclosure is susceptible to various modifications and alternative forms, specific embodiments thereof are shown by way of example in the drawings and will herein be described in detail. It should be understood, however, that the drawings and detailed description thereto are not intended to limit the disclosure to the particular form disclosed, but on the contrary, the present disclosure is to cover all modifications, equivalents and alternatives falling within the spirit and scope of the present disclosure as defined by the appended claims.

DESCRIPTION OF ILLUSTRATIVE EMBODIMENTS

Figure 3:
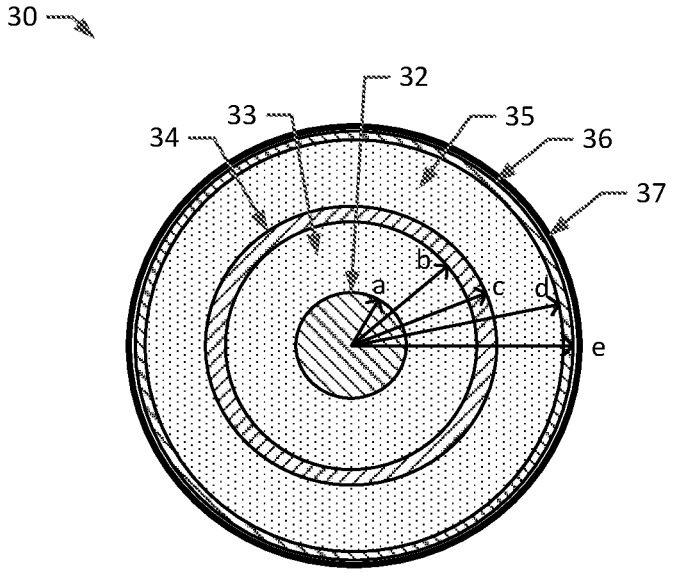
FIG. 3 is a cross-sectional view through a single-ended cable having an inverted cable design in accordance with one embodiment of the present disclosure.

FIG. 3 provides a cross-sectional view through a single-ended cable 30 having an inverted cable design in accordance with one embodiment of the present disclosure. As shown in FIG. 3, single-ended cable 30 may generally include a center conductor 32, a middle conductor 34 and an outer conductor 36, each separated by a dielectric layer. For example, the middle conductor 34 is concentrically arranged around the center conductor 32 and separated from the center conductor by a first dielectric layer 33. The outer conductor 36 is concentrically arranged around the middle conductor 34 and separated from the middle conductor 34 by a second dielectric layer 35. A protective outer jacket 37 is provided around the outer conductor 36.

The center conductor 32, middle conductor 34 and outer conductor 36 may comprise substantially any electrically conductive material. In some embodiments, the center conductor 32 may be implemented as a cylindrical wire, while the middle conductor 34 and outer conductor 36 are implemented as foil conductors or braided conductors. For example, the center conductor 32 may be implemented with silver, copper, tin-plated copper, or silver-plated copper wire, while the middle conductor 34 and outer conductor 36 are implemented with silver-plated copper foil or braided conductors. It is recognized, however, that the center conductor 32, middle conductor 34 and outer conductor 36 are not restricted to such materials, and may be implemented with any suitable electrically conductive material having low resistivity, low permeability, good solderability and plasticity.

The first dielectric layer 33 and the second dielectric layer 35 may comprise substantially any electrically insulative material. In some embodiments, the first dielectric layer 33 and the second dielectric layer 35 may implemented with polyethylene (PE) or polytetrafluoroethylene (PTFE), for example. It is recognized, however, that the first dielectric layer 33 and the second dielectric layer 35 are not restricted to such materials, and may be implemented with any suitable dielectric material having low conductivity and low relative permittivity.

The center conductor 32, first dielectric layer 33, middle conductor 34, second dielectric layer 35 and outer conductor 36 may be further described as having a particular radius and/or thickness. As shown in FIG. 3, for example, center conductor 32 may have a radius 'a.' The first dielectric layer 33 surrounding the center conductor 32 may have an inner radius 'a,' an outer radius 'b' and a thickness defined by b-a. The middle conductor 34 surrounding the first dielectric layer 33 may have an inner radius 'b,' an outer radius 'c' and a thickness defined by c-b. The second dielectric layer 35 surrounding the middle conductor 34 may have an inner radius 'c,' an outer radius 'd' and a thickness defined by d-c. The outer conductor 36 surrounding the second dielectric layer 35 may have an inner radius 'd,' an outer radius 'e' and a thickness defined by e-d.

The particular materials and dimensions used to implement the various cable components may depend on several factors including, for example, the electromagnetic properties of the materials used to implement the various conductors and dielectric layers, the desired characteristic impedance and loss provided by the cable 30, the cable length, and the signal transmission frequency. In one example embodiment, the center conductor 32 may be a 20 AWG to 26 AWG silver, copper, tin-plated copper, or silver-plated copper wire, the first dielectric layer 33 may be PE or PTFE layer having a thickness between 5 mils and 20 mils, the middle conductor 34 may be a silver-plated copper foil or braided conductor having a having a thickness between 2 mils and 10 mils, the second dielectric layer 35 may be PE or PTFE layer having a thickness between 10 mils and 50 mils, and the outer conductor 36 may be a silver-plated copper foil or braided conductor having a having a thickness between 2 mils and 10 mils. It is recognized, however, that materials and dimensions mentioned above are merely one example of materials and dimensions that may be used to implement the single-ended cable 30 shown in FIG. 3.

Unlike conventional single-ended cables (such as coax), the single-ended cable 30 shown in FIG. 3 utilizes an inverted cable design, in which the middle conductor 34 is used for signal transmission, the center conductor 32 is used as a return or drain line to ground, and the outer conductor 36 is used as a shield. At higher signal transmission frequencies (e.g., 1 GHz and above for some conductors), the current density through the single-ended cable 30 is concentrated primarily along the outside of the center conductor 32 (e.g., at $r_o$=a), the inner and outer surfaces of the middle conductor 34 (e.g., at $r_i$=b and $r_o$=c), and the inside surface of the outer conductor 36 (e.g., at $r_i$=d) due to the skin effect.

Since the middle conductor 34 has a significantly larger surface area for signal conduction than the center conductor 32, the single-ended cable 30 shown in FIG. 3 transmits high-speed, single-ended signals with significantly less loss than conventional single-ended (e.g., coaxial) cable designs), which transmit single-ended signals along the center conductor. In some embodiments, the surface area of the middle conductor 34 may be approximately 2 to 5 times larger than the surface area of the center conductor 32. In such embodiments, the loss exhibited through single-ended cable 30 may be reduced by approximately 50-75% compared to conventional coaxial cable designs with similar dimensions.

Although a single-ended cable 30 is illustrated in FIG. 3 and discussed above, most high-speed signal transmission applications utilize differential signals due to the greater noise immunity, lower voltages and faster switching times provided by differential signaling. To support differential high-speed signals, a dual-axial cable (or twin-axial cable) is provided herein with an inverted cable design.

The dual-axial cables shown and described herein may be operable for transmitting differential high-speed signals in accordance with a variety of well-known communication standards, protocols and interfaces. For example, the dual-axial cables may be used to transmit differential high-speed signals in accordance with a Peripheral Component Interconnect Express (PCIe) bus standard, a Serial Attached Small Computer System Interface (SAS) protocol, a Serial Advanced Technology Attachment (SATA) bus interface, or another communication standard, protocol or interface that utilizes differential signaling.

Figure 4:
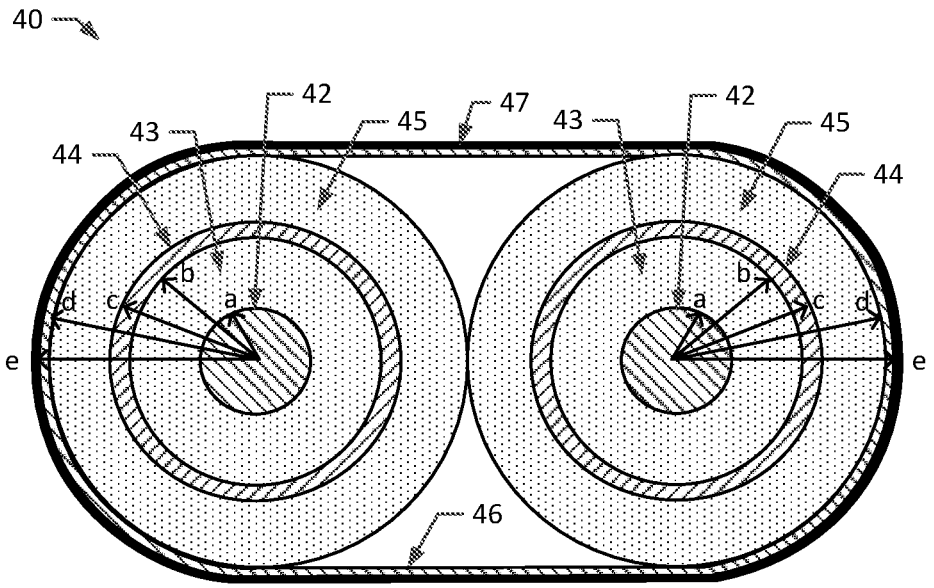
FIG. 4 is a cross-sectional view through a dual-axial cable having an inverted cable design in accordance with one embodiment of the present disclosure.
Figure 5:
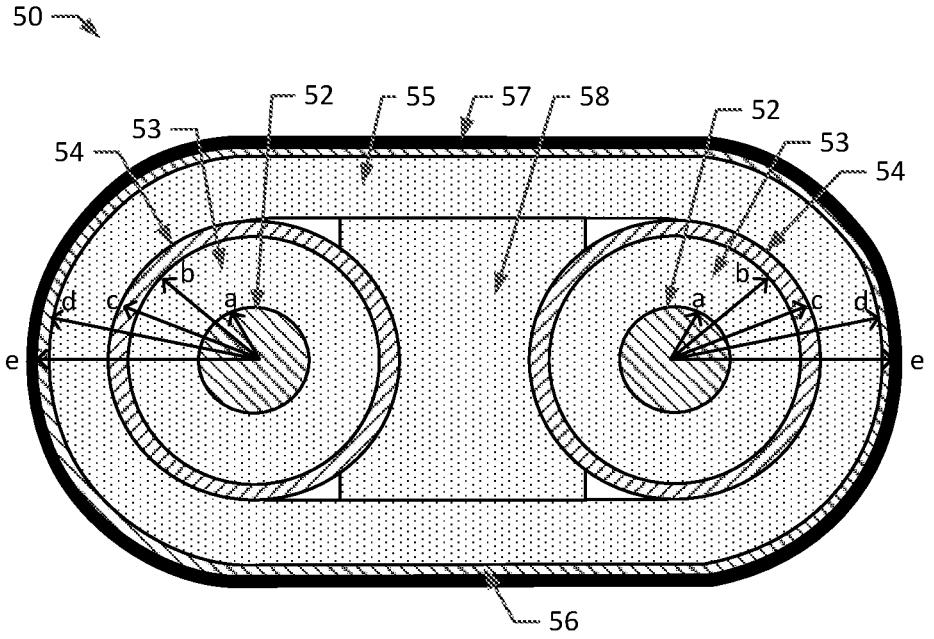
FIG. 5 is a cross-sectional view through a dual-axial cable having an inverted cable design in accordance with another embodiment of the present disclosure.

FIGS. 4 and 5 provide various embodiments of a dual-axial cable (or twin-axial cable) having an inverted cable design in accordance with the present disclosure. As shown in FIGS. 4 and 5, the dual-axial cables 40/50 may each include a pair of inner cables arranged side-by-side, or parallel to one another. Each of the inner cables includes a center conductor 42/52, a first dielectric layer 43/53 surrounding the center conductor, and a middle conductor 44/54 surrounding the first dielectric layer 43/53. The dual-axial cables 40/50 shown in FIGS. 4 and 5 also include one or more second dielectric layers 45/55 surrounding pair of inner cables, an outer conductor 46/56 surrounding the one or more second dielectric layers 45/55 and a protective outer jacket 47/57 surrounding the outer conductor 46/56.

The center conductors 42/52, the first dielectric layers 43/53, the middle conductors 44/54, the one or more second dielectric layers 45/55 and the outer conductor 46/56 may generally be implemented as described above. For example, the center conductors 42/52, the middle conductors 44/54 and the outer conductor 46/56 may comprise substantially any electrically conductive material, including but not limited to silver wire, copper wire, tin-plated copper wire, or silver-plated copper wire, foil or braided conductors. The first dielectric layers 43/53 and the one or more second dielectric layers 45/55 may comprise substantially any electrically insulative material, including but not limited to PE or PTFE.

In one example embodiment, the center conductors 42/52 may each be implemented with a 20 AWG to 26 AWG silver, copper, tin-plated copper, or silver-plated copper wire, the first dielectric layers 43/53 may each be implemented with a PE or PTFE layer having a thickness (b-a) between 5 mils and 20 mils, the middle conductors 44/54 may each be implemented with a silver-plated copper foil or braided conductor having a having a thickness (c-b) between 2 mils and 10 mils, the one or more second dielectric layers 45/55 may each be implemented with a PE or PTFE layer having a thickness (d-c) between 10 mils and 50 mils, and the outer conductor 46/56 may be implemented with a silver-plated copper foil or braided conductor having a having a thickness (e-d) between 2 mils and 10 mils. It is recognized, however, that materials and dimensions mentioned above are merely one example of materials and dimensions that may be used to implement the dual-axial cables 40/50 shown in FIGS. 4 and 5.

Unlike conventional dual-axial cables (such as twin-axial cables), the dual-axial cables 40/50 shown in FIGS. 4 and 5 utilize an inverted cable design, in which the middle conductors 44/54 are used for differential signal transmission, the center conductors 42/52 are used as a return or drain line to ground, and the outer conductor 46/56 is used as a shield. At higher signal transmission frequencies (e.g., 1 GHz and above for some conductors), the current density through the dual-axial cables 40/50 is concentrated primarily along the outside of the center conductors 42/52 (e.g., at $r_o$=a), the inner and outer surfaces of the middle conductors 44/54 (e.g., at $r_i$=b and $r_o$=c), and the inside surface of the outer conductor 46/56 (e.g., at $r_i$=d) due to the skin effect.

Since the middle conductors 44/54 have a significantly larger surface area for signal conduction than the center conductors 42/52, the dual-axial cables 40/50 shown in FIGS. 4 and 5 transmit high-speed, differential signals with significantly less loss than conventional dual-axial (e.g., twin-axial) cable designs, which transmit differential signals along the center conductors. In some embodiments, the surface area of the middle conductors 44/54 may be approximately 2 to 5 times larger than the surface area of the center conductors 42/52. In such embodiments, the loss exhibited through dual-axial cables 40/50 may be reduced by approximately 50-75% compared to conventional twin-axial cable designs with similar dimensions.

The embodiments shown in FIGS. 4 and 5 generally differ by including one or more second dielectric layers 45/55. In the dual-axial cable 40 shown in FIG. 4, for example, a pair of second dielectric layers 45 is provided and arranged, such that each of the second dielectric layers 45 surrounds one of the middle conductors 44. However, the dual-axial cable 50 shown in FIG. 5 includes only one second dielectric layer 55.

In the dual-axial cable 50 shown in FIG. 5, the second dielectric layer 55 is wrapped around the pair of inner cables, and a dielectric spacer 58 is inserted between the inner cables. The dielectric spacer 58 is provided in the embodiment shown in FIG. 5 to electrically isolate the signals transmitted along the middle conductors 44/54 and to maintain the desired cable impedance. The dielectric spacer 58 may generally be implemented with substantially any electrically insulative material, including but not limited to PE or PTFE. In one example embodiment, the dielectric spacer 58 may be implemented with a PE or PTFE layer having a thickness between 0 mils (for low impedance cables) and 10's of mils (for higher impedance cables).

As noted above, the inverted cable designs shown in FIGS. 3-5 may be used to reduce cable loss (e.g., by approximately 50-75%) compared to conventional cable designs with similar dimensions. In some embodiments, the inverted cable designs shown in FIGS. 3-5 may instead be used to reduce cable dimensions (e.g., by approximately 20-40%), compared to conventional cable designs, for a given loss target. In some embodiments, the inverted cable designs shown in FIGS. 3-5 may be used to reduce both cable loss and cable dimensions, resulting in lower loss cables that are thinner, lighter, more flexible and less costly than conventional cable designs.

Although the inverted cable designs shown in FIGS. 3-5 may be used to communicate single-ended and differential signals at substantially any transmission frequency/throughput, the lower loss provided by the inverted cable designs may be particularly beneficial when communicating signals at higher transmission speeds and/or throughput. In some embodiments, the inverted cable designs may be used transmit high-speed data signals at a throughput greater than 15 Gigabits per second (Gbps), more specifically, greater than 40 Gbps, and more specifically, greater than 60 Gbps. In some embodiments, the lower loss provided by the inverted cable designs may enable high-speed data signals to be transmitted at a throughput of 100 Gbps or more.

The inverted cable designs described herein may be used externally to connect multiple information handling systems (IHSs) together, or internally to connect printed circuit board (PCBs) within an information handling system together. In some embodiments, the inverted cable designs described herein may be connected to a mating connector, which in turn, may be connected to a corresponding connector on a PCB or an external connector provided on a chassis of an IHS.

Figure 6:
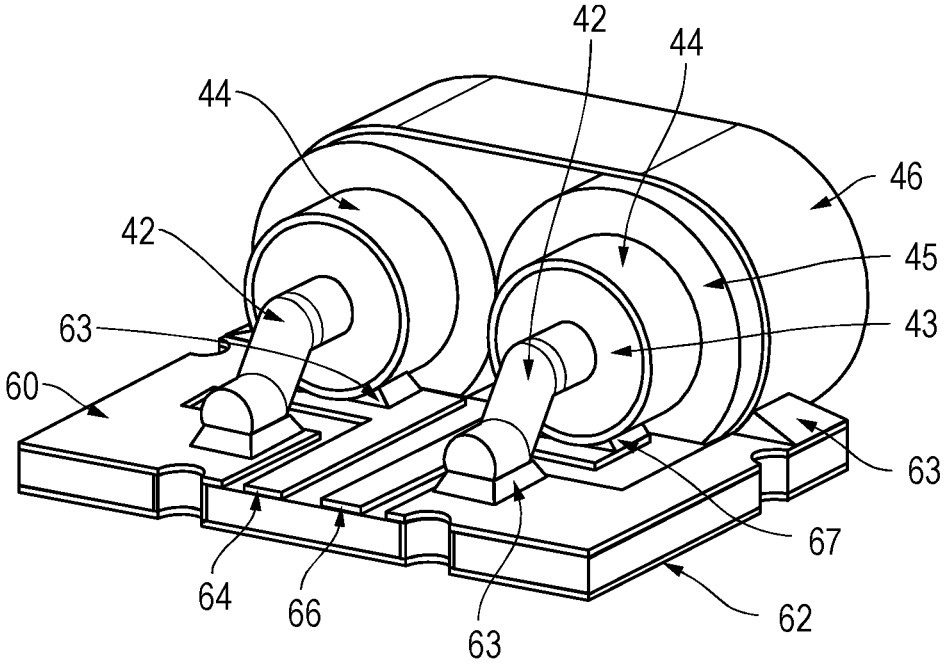
FIG. 6 is a perspective view of the dual-axial cable shown in FIG. 4 connected to a mating connector (e.g., a paddle board).
Figure 7:
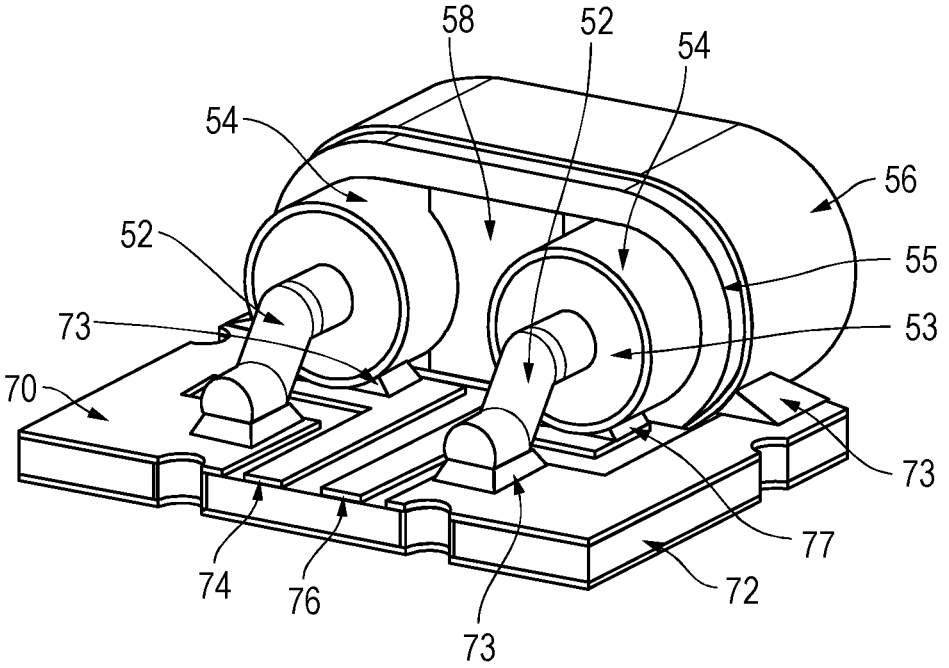
FIG. 7 is a perspective view of the dual-axial cable shown in FIG. 5 connected to a mating connector (e.g., a paddle board).

FIGS. 6 and 7 illustrate one embodiment of a mating connector (e.g., a paddle board), which may be used to connect the inverted cable designs described herein to a corresponding connector on a PCB. Although a particular paddle board design is illustrated in FIGS. 6 and 7, one skilled in the art would recognize that the inverted cable designs shown in FIGS. 3-5 may be connected to other paddle board designs, jumpers, interconnects and connectors.

FIG. 6 provides a perspective view of a mating connector 60 connected to one end of the dual-axial cable 40 shown in FIG. 4. The mating connector 60 generally includes a ground plane 62 and a pair of differential signal traces 64 and 66. The center conductors 42 and the outer connector 46 of the dual-axial cable 40 are connected to the ground plane 62 at solder points 63. One middle connector 44 of the dual-axial cable 40 is connected to the positive (DP) signal trace 64 at solder point 63, while the other middle connector 44 is connected to the negative (DN) signal trace 66 at solder point 67.

FIG. 7 provides a perspective view of a mating connector 70 connected to one end of the dual-axial cable 50 shown in FIG. 5. Like the mating connector 70 shown in FIG. 7, the mating connector 60 shown in FIG. 6 generally includes a ground plane 72 and a pair of differential signal traces 74 and 76. The center conductors 52 and the outer connector 56 of the dual-axial cable 50 are connected to the ground plane 72 at solder points 73. One middle connector 54 of the dual-axial cable 50 is connected to the positive (DP) signal trace 74 at solder point 73, while the other middle connector 54 is connected to the negative (DN) signal trace 76 at solder point 77.

Figure 8:
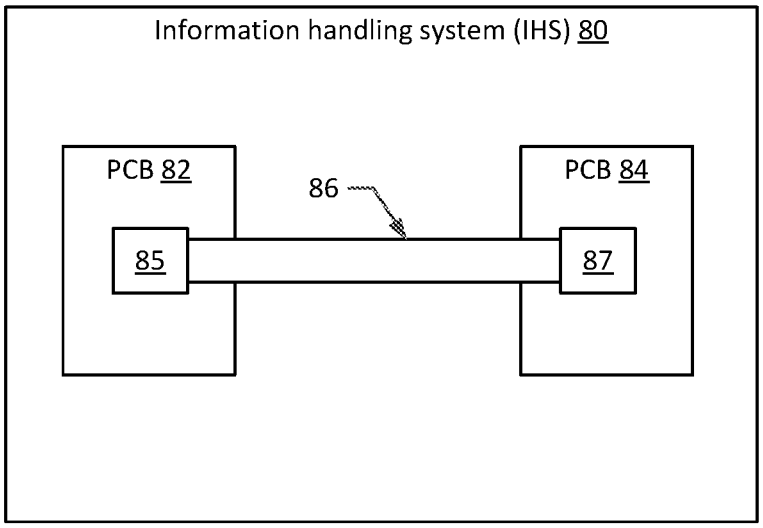
FIG. 8 is a block diagram illustrating how the inverted cable designs described herein may be used to communicate high-speed signals between two printed circuit boards (PCBs) included within an information handling system (IHS)
Figure 9:
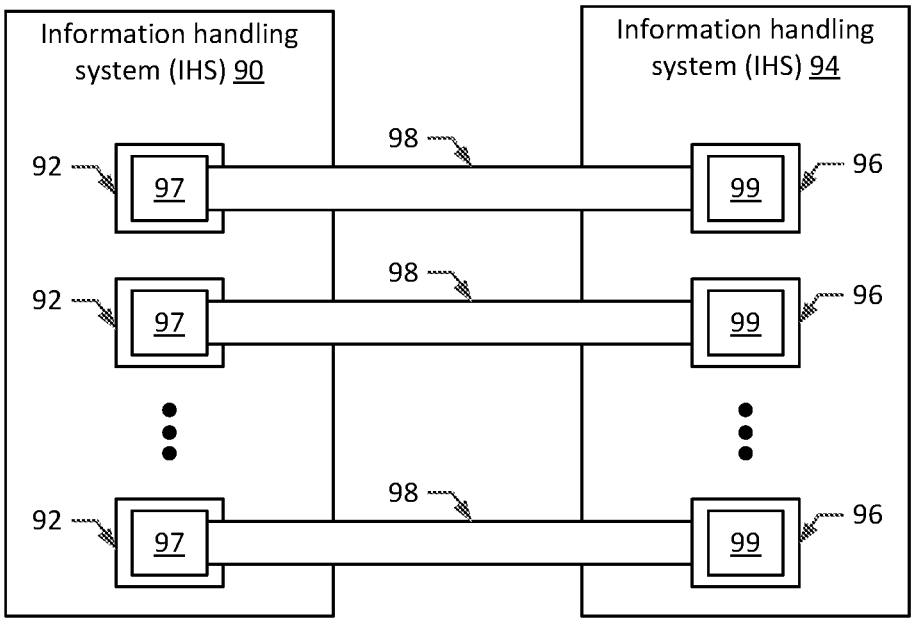
FIG. 9 is a block diagram illustrating how the inverted cable designs described herein may be used to communicate high-speed signals between multiple IHSs.

FIGS. 8 and 9 illustrate various ways in which the inverted cable designs described herein may be used to communicate high-speed data signals between multiple information handling systems (IHSs), or within a single IHS, with substantially less loss than conventional cable designs. Although various examples are provided in FIGS. 8 and 9, one skilled in the art would recognize other ways in which the inverted cable designs described herein could be used to communicate high-speed data signals.

In the embodiment shown in FIG. 8, an inverted cable 86 is coupled for communicating high-speed data signals between at least two printed circuit boards (PCBs) 82 and 84 provided within an information handling system (IHS) 80. The inverted cable 86 is terminated at each end with a pair of mating connectors 85 and 87.

The mating connectors 85 and 87 shown in FIG. 8 may include one or more ground terminals (or traces) and one or more signal terminals (or traces), which are configured for coupling to corresponding ground terminal(s) and signal terminal(s) on PCBs 82 and 84. In some embodiments, a mating connector 60/70 as shown in FIGS. 6-7 may be used to implement the mating connectors 85 and 87 shown in FIG. 8.

The inverted cable 86 shown in FIG. 8 may include at least a center conductor, a middle conductor and an outer conductor, each separated by dielectric layer. The center conductor and the outer conductor of the inverted cable 86 may be coupled to ground terminals on the mating connectors 85 and 87, which in turn, are coupled to corresponding ground terminals on the PCBs 82 and 84. The middle conductor of the inverted cable 86 may be coupled to data terminals on the mating connectors 85 and 87, which in turn, are coupled to corresponding data terminals on the PCBs 82 and 84.

In some embodiments, a dual-axial cable 40/50 as shown in FIG. 4 or 5 may be used to implement the inverted cable 86 shown in FIG. 8. In such embodiments, the dual-axial cable 40/50 may be used to communicate differential, high-speed data signals between PCBs 82 and 84 with less loss and/or with smaller cable dimensions than conventional dual-axial cables. When differential signaling is not required, the single-ended cable 30 shown in FIG. 3 may alternatively be used to communicate high-speed data signals between PCBs 82 and 84.

In some embodiments, the dual-axial cable 40 shown in FIGS. 4 and 6 or the dual-axial cable 50 shown in FIGS. 5 and 7 may be used to communicate differential signals (e.g., PCIe, SAS, or SATA, signals) between PCBs 82 and 84. In one example embodiment, the dual-axial cable 40/50 may be used to communicate PCIe signals between PCBs 82 and 84. Due to the lower loss provided by the inverted cable design, the dual-axial cable 40/50 may be used to communicate high-speed (e.g., up to 32 Gbps and higher) PCIe signals between PCBs 82 and 84, while meeting specified loss budgets (e.g., 15 dB) even when cable lengths exceed 700 mm. The lower loss provided by the inverted cable design may also enable the dual-axial cable described herein to communicate other signals (e.g., within other communication fabrics) with even greater speed and/or throughput (e.g., up to 100 Gbps or more).

In the embodiment shown in FIG. 9, one or more inverted cables 98 are coupled for communicating high-speed data signals between a first external connector 92 provided on a chassis of a first IHS 90 and a second external connector 96 provided on a chassis of a second IHS 94. The one or more inverted cables 98 are terminated at each end with a pair of mating connectors 97 and 99. The mating connectors 97 and 99 shown in FIG. 9 may include one or more ground terminals and one or more signal terminals, which are configured for coupling to corresponding ground terminal(s) and signal terminal(s) included within the external connectors 92 and 96.

The inverted cable(s) 98 shown in FIG. 9 may include at least a center conductor, a middle conductor and an outer conductor, each separated by dielectric layer. The center conductor and the outer conductor of the inverted cable(s) 98 may be coupled to ground terminals on the mating connectors 97 and 99, which are coupled to corresponding ground terminals of the external connectors 92 and 96. The middle conductor of the inverted cable(s) 98 may be coupled to data terminals on the mating connectors 97 and 99, which are coupled to corresponding data terminals of the external connectors 92 and 96.

In some embodiments, the mating connectors 97/99 and the external connectors 92/96 may be configured according to a communication standard being used to transmit the high-speed data signals between the IHSs 90/94. As such, the mating connectors 97/99 and the external connectors 92/96 may utilize substantially any type of connector, which is suitable for (or defined by) a particular communication standard.

In some embodiments, a dual-axial cable 40/50 as shown in FIG. 4 or 5 may be used to implement the one or more inverted cables 98 shown in FIG. 9. In such embodiments, the dual-axial cable 40/50 may be used to communicate differential, high-speed data signals between the first IHS 90 and the second IHS 94 with less loss and/or with smaller cable dimensions than conventional dual-axial cables. When differential signaling is not required, the single-ended cable 30 shown in FIG. 3 may alternatively be used to communicate high-speed data signals between IHSs 90 and 94.

In some embodiments, a dual-axial cable 40/50 as shown in FIG. 4 or 5 may be used to communicate differential signals between IHSs 90 and 94. Examples of differential signals that may be communicated between IHS 90 and IHS 94 via dual-axial cable 40/50 include, but are not limited to, PCIe signals, SAS signals, SATA signals, Ethernet signals, HT signals, IB signals, XAUI signals, USB signals, HDMI signals, DP signals, etc. In one example embodiment, the dual-axial cable 40/50 may be used to communicate PCIe signals between IHSs 90 and 94. Due to the lower loss provided by the inverted cable design, the dual-axial cable 40/50 may be used to communicate high-speed (e.g., up to 32 Gbps and higher) PCIe signals between IHSs 90 and 94, while meeting specified loss budgets (e.g., 15 dB) even when cable lengths exceed 700 mm.

Figure 10:
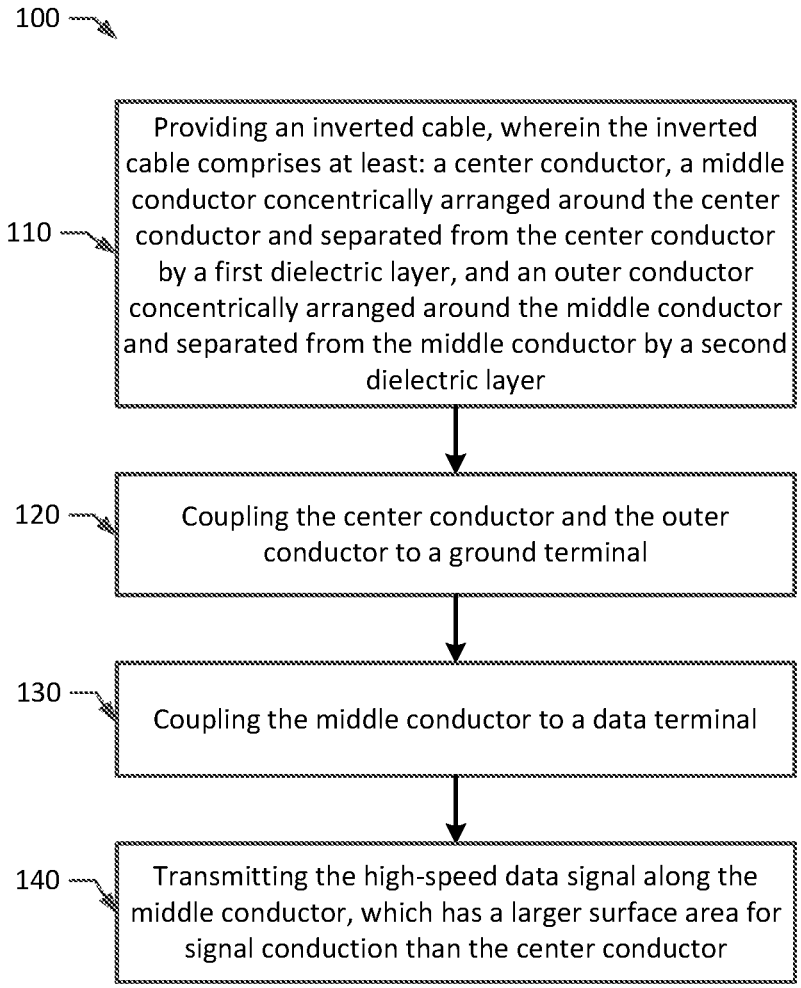
FIG. 10 is a flowchart illustrating one embodiment of a method that may be used to transmit a high-speed data signal in accordance with the present disclosure.

FIG. 10 illustrates one embodiment of a method 100 for transmitting a high-speed data signal. In general, the method 100 may include providing an inverted cable (in step 110), where the inverted cable comprises at least: a center conductor, a middle conductor concentrically arranged around the center conductor and separated from the center conductor by a first dielectric layer, and an outer conductor concentrically arranged around the middle conductor and separated from the middle conductor by a second dielectric layer. The method 100 also includes coupling the center conductor and the outer conductor to a ground terminal (in step 120) and coupling the middle conductor to a data terminal (in step 130). The method 100 further includes transmitting the high-speed data signal along the middle conductor, which has a larger surface area for signal conduction than the center conductor (in step 140).

In some embodiments, the method 100 may further include coupling the inverted cable between a first printed circuit board (PCB) and a second PCB included within an information handling system (IHS), such that the center conductor and the outer conductor are coupled to ground terminals on the first PCB and the second PCB, and the middle connector is coupled to data terminals on the first PCB and the second PCB.

In other embodiments, the method 100 may further include coupling the inverted cable between a first connector provided on a chassis of a first information handling system (IHS) and a second connector provided on a chassis of a second IHS, such that the center conductor and the outer conductor are connected to ground terminals included within the first connector and the second connector, and the middle connector is connected to data terminals included within the first connector and the second connector.

Unlike conventional methods, which transmit signals along the center conductor, the method 100 shown in FIG. 10 transmits the high-speed data signal along the middle conductor. In some embodiments, for example, the surface area of the middle conductor may be approximately 2 to 5 times larger than the surface area of the center conductor. Because the middle conductor provides a larger surface area for signal conductance than the center conductor, the method 100 shown in FIG. 10 transmits the high-speed data signal with significantly less loss than conventional methods, especially at higher signal transmission speeds. In one example, the method 100 shown in FIG. 10 may reduce loss through the inverted cable by at least 50% by transmitting the high-speed data signal along the middle conductor (in step 140), instead of the center conductor. In some embodiments, the method 100 may transmit the high-speed data signal at a frequency greater than 15 Gigabits per second (Gbps), more specifically, greater than 40 Gbps, and more specifically, greater than 60 Gbps (in step 140).

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may generally include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communicating with external devices as well as various input and output (I/O) devices, such as a keyboard, a mouse, touch screen and/or a video display. The information handling system may also include one or more buses operable to transmit communications between the various hardware components.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed systems and methods may be utilized in various combinations and/or independently. Thus the invention is not limited to only those combinations shown herein, but rather may include other combinations.

What is claimed is:

1. A method for transmitting a high-speed data signal, the method comprising:

providing an inverted cable, wherein the inverted cable comprises at least:

a center conductor;

a middle conductor concentrically arranged around the center conductor and separated from the center conductor by a first dielectric layer; and an outer conductor concentrically arranged around the middle conductor and separated from the middle conductor by a second dielectric layer;

coupling the center conductor and the outer conductor to a ground terminal;

coupling the middle conductor to a data terminal; and transmitting the high-speed data signal along the middle conductor, which has a larger surface area for signal conduction than the center conductor.

2. The method of claim 1, further comprising coupling the inverted cable between a first printed circuit board (PCB) and a second PCB included within an information handling system (IHS), such that the center conductor and the outer conductor are coupled to ground terminals on the first PCB and the second PCB, and the middle connector is coupled to data terminals on the first PCB and the second PCB.

3. The method of claim 1, further comprising coupling the inverted cable between a first connector provided on a chassis of a first information handling system (IHS) and a second connector provided on a chassis of a second IHS, such that the center conductor and the outer conductor are connected to ground terminals included within the first connector and the second connector, and the middle connector is connected to data terminals included within the first connector and the second connector.

4. The method of claim 1, wherein said transmitting the high-speed data signal along the middle conductor comprises transmitting the high-speed data signal at a throughput greater than 15 Gbps.

5. The method of claim 1, wherein the surface area of the middle conductor is 2 to 5 times larger than a surface area of the center conductor.

6. The method of claim 1, wherein said transmitting the high-speed data signal along the middle conductor reduces loss through the inverted cable by at least 50% compared to transmitting the high-speed data signal along the center conductor.

7. A system, comprising:

an inverted cable operable for transmitting a high-speed data signal between multiple information handling systems (IHSs), or between multiple printed circuit board (PCBs) included within an IHS;

wherein the inverted cable comprises at least:

a center conductor;

a middle conductor concentrically arranged around the center conductor and separated from the center conductor by a first dielectric layer; and an outer conductor concentrically arranged around the middle conductor and separated from the middle conductor by a second dielectric layer; and wherein the inverted cable is coupled for transmitting the high-speed data signal along the middle conductor, which has a larger surface area for signal conduction than the center conductor.

8. The system of claim 7, further comprising a first IHS and a second IHS, wherein the inverted cable is coupled between a first connector provided on a chassis of the first IHS and a second connector provided on a chassis of a second IHS, such that the center conductor and the outer conductor are connected to ground terminals included within the first connector and the second connector, and the middle connector is connected to data terminals included within the first connector and the second connector.

9. The system of claim 7, further comprising a first printed circuit board (PCB) and a second PCB included within an IHS, wherein the inverted cable is coupled between the first PCB and the second PCB, such that the center conductor and the outer conductor are coupled to ground terminals on the first PCB and the second PCB, and the middle connector is coupled to data terminals on the first PCB and the second PCB.

10. The system of claim 7, wherein the inverted cable is operable for transmitting the high-speed data signal in accordance with a Peripheral Component Interconnect Express (PCIe) bus standard, a Serial Attached Small Computer System Interface (SAS) protocol, or a Serial Advanced Technology Attachment (SATA) bus interface.

11. The system of claim 7, wherein the inverted cable is a dual-axial cable comprising:

a pair of inner cables arranged parallel to one another, wherein each of the inner cables includes a center conductor, a first dielectric layer surrounding the center conductor, and a middle conductor surrounding the first dielectric layer;

one or more second dielectric layers surrounding the pair of inner cables;

an outer conductor surrounding the one or more second dielectric layers; and a protective outer jacket surrounding the outer conductor.

12. The system of claim 11, wherein the one or more second dielectric layers comprise a pair of second dielectric layers arranged, such that each of the second dielectric layers surrounds one of the middle conductors included within the pair of inner cables.

13. The system of claim 11, wherein the one or more second dielectric layers comprise only one second dielectric layer wrapped around the pair of inner cables.

14. The system of claim 13, further comprising a dielectric spacer inserted between the pair of inner cables.

15. A dual-axial cable terminated at each end with a pair of mating connectors, wherein the dual-axial cable comprises:

a pair of inner cables arranged parallel to one another, wherein each of the inner cables includes a center conductor, a first dielectric layer surrounding the center conductor, and a middle conductor surrounding the first dielectric layer;

one or more second dielectric layers surrounding the pair of inner cables;

an outer conductor surrounding the one or more second dielectric layers; and a protective outer jacket surrounding the outer conductor;

wherein the center conductors and the outer conductor of the dual-axial cable are coupled to ground terminals on the pair of mating connectors; and wherein the middle conductors of the dual-axial cable are coupled to data terminals on the pair of mating connectors.

16. The dual-axial cable of claim 15, wherein the one or more second dielectric layers comprise a pair of second dielectric layers arranged, such that each of the second dielectric layers surrounds one of the middle conductors included within the pair of inner cables.

17. The dual-axial cable of claim 15, wherein the one or more second dielectric layers comprise only one second dielectric layer wrapped around the pair of inner cables.

18. The dual-axial cable of claim 17, further comprising a dielectric spacer inserted between the pair of inner cables.

19. The dual-axial cable of claim 15, wherein the dual-axial cable is operable for transmitting a differential data signal along the middle conductors of the dual-axial cable.

20. The dual-axial cable of claim 19, wherein the dual-axial cable is operable for transmitting a differential data signal in accordance with a Peripheral Component Interconnect Express (PCIe) bus standard, a Serial Attached Small Computer System Interface (SAS) protocol, or a Serial Advanced Technology Attachment (SATA) bus interface.

* * * * *